US006407501B1

(12) United States Patent
Song et al.

(10) Patent No.: US 6,407,501 B1
(45) Date of Patent: Jun. 18, 2002

(54) SEALING AREA FOR FLAT DISPLAY HAVING MOISTURE-RESISTANT COATING LAYER FRIT GLASS SEALING EVACUATION PIPE

(75) Inventors: In-sik Song, Suwon; Jae-sang Jin, Asan; Hae-woon Cho, Cheonan, all of (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/559,731

(22) Filed: Apr. 28, 2000

(30) Foreign Application Priority Data

Jul. 1, 1999 (KR) ..... 99-26340

(51) Int. Cl.[7] ..... H01J 1/62; H01J 63/04
(52) U.S. Cl. ..... 313/495; 313/635; 313/479
(58) Field of Search ..... 313/495, 496, 313/634, 635, 477 R, 479

(56) References Cited

U.S. PATENT DOCUMENTS 4,266,053 A * 5/1981 Imanake et al. ..... 544/196
5,677,385 A * 10/1997 Miyaka et al. ..... 525/286
5,731,050 A * 3/1998 Kotsubo et al. ..... 428/1
5,905,335 A * 5/1999 Fushimi et al. ..... 313/495
5,961,893 A * 10/1999 Honda et al. ..... 252/587

FOREIGN PATENT DOCUMENTS

JP 58169847 A * 10/1983
JP 60175341 A * 9/1985
JP 63259943 A * 10/1988
JP 02223130 A * 9/1990
JP 10074583 A * 3/1998

* cited by examiner

*Primary Examiner*—Vip Patel
*Assistant Examiner*—Kevin Quarterman
(74) *Attorney, Agent, or Firm*—Lowe Hauptman Gilman & Berner, LLP

(57) ABSTRACT

A sealing area of a flat display is provided. The sealing area includes front and rear substrates provided to be opposed to each other, which are sealed to each other using frit glass so as to form a discharge space, an evacuation pipe sealed to the outer surface of the rear substrate using frit glass, and a moisture-resistant coating layer formed on the surface of the frit glass.

5 Claims, 3 Drawing Sheets

SEALING AREA FOR FLAT DISPLAY HAVING MOISTURE-RESISTANT COATING LAYER FRIT GLASS SEALING EVACUATION PIPE

BACKGROUND OF THE INVENTION

1. Field of the Invention

The present invention relates to a flat display, and more particularly, to a sealing area of a flat display in which an acryl-type moisture-resistant coating layer is formed on the surface of a frit glass exposed to the air.

2. Description of the Related Art

Generally, flat displays include plasma display panels (PDPs), liquid crystal displays (LCDs), vacuum fluorescent displays (VFD), electroluminescent (EL) displays and field emission displays (FEDs). In PDPs, a gas is injected into cells formed between two substrates having transparent electrodes of a predetermined pattern before sealing the cells, a discharge voltage is applied to the sealed cells, and ultraviolet rays generated due to the discharge voltage excite phosphors formed in a predetermined pattern, thereby displaying desired numerals, characters or graphics.

As shown in FIG. 1, a PDP includes a front substrate 11 and a rear substrate 12. Common electrodes 13 and scanning electrodes 14 are formed on the bottom surface of the front substrate 11 in a stripe pattern. Bus electrodes 15 are formed on the common and scanning electrodes 13 and 14 to reduce line resistance. A dielectric layer 16 is formed on the bottom surface of the front substrate 11 such that the common and scanning electrodes 13 and 14 are embedded in the dielectric layer 16. A protective layer 17, for example, a MgO layer, is formed on the dielectric layer 16.

Meanwhile, address electrodes 18 are formed on the rear substrate 12 to be opposed to the front substrate 11 in a strip pattern crossing the common and scanning electrodes 13 and 14. The address electrodes 18 are embedded in a dielectric layer 19. Partition walls 100 for defining discharge spaces are formed on the dielectric layer 19. Each cell defined by the partition walls 100 is coated with a phosphor material layer 110 of red, green and blue (RGB).

In the operation of the conventional PDP having the above structure, once a voltage is applied between the scanning electrodes 14 and the address electrodes 18, pre-discharge occurs and wall charges are produced in the discharge space. In the discharge spacing having the wall charges, main discharge occurs between the common electrodes 13 and the scanning electrodes 14, thereby forming plasma. Ultraviolet rays are emitted from the plasma and excite the phosphor material layers 110, thereby realizing an image.

To fill the inside of the PDP with a discharge gas, a panel comprised of the front and rear substrates 11 and 12 are sealed using frit glass to hold the airtightness of the space between the front substrate 11 and the rear substrate 12, and the space is vacuum evacuated and filled with a gas. For this purpose, as shown in FIG. 2, an evacuation hole 21 is formed on the rear substrate 12, and an evacuation pipe 22 is provided around the evacuation hole 21. The evacuation pipe 22 is sealed to the rear substrate 12 through a sealing area 23 composed of a frit glass 23*a*. In other words, the frit glass 23*a* is melt at a predetermined temperature, thereby sealing the evacuation pipe 22.

However, because the sealing area is exposed to the air, the surface of the sealing area tends to deform to an acicular shape due to permeation of moisture under a hot and humid environment. The surface of the sealing area is visually shiny and smooth in a normal state. In an experiment for testing an environmental reliability, moisture gradually made its way under the surface of the frit glass 23*a* in a test environment of 50° C. and 98% humidity and finally the surface of the sealing area deformed as if salt was sprayed on the surface thereof. Flat display products are sold in many regions in various climates. In this case, when products are exposed to an hot and humid environment for a long period of time, a sealing area deforms resulting in cracks on the surface of the sealing area or vacuum break of a panel.

SUMMARY OF THE INVENTION

To solve the above problem, an object of the present invention is to provide a sealing area of a flat display in which an acryl-type moisture-resistant coating layer is formed on the surface of a frit glass exposed to the air.

To achieve the above object, the present invention provides a sealing area of a flat display. The sealing area includes front and rear substrates provided to be opposed to each other, which are sealed to each other using frit glass so as to form a discharge space, an evacuation pipe sealed to the outer surface of the rear substrate using frit glass, and a moisture-resistant coating layer formed on the surface of the frit glass.

The moisture-resistant coating layer is preferably formed on the surface of the frit glass and the surface of the evacuation pipe.

The moisture-resistant coating layer is formed of an acryl-type material preferably including 28.6% of acryl resin, 9.9% of aromatic solvent, 8.3% of alcohol solvent and 8.3% of ester solvent.

The moisture-resistant coating layer is preferably 10 nm thick.

BRIEF DESCRIPTION OF THE DRAWINGS

The above object and advantage of the present invention will become more apparent by describing in detail preferred embodiments thereof with reference to the attached drawings in which.

DETAILED DESCRIPTION OF THE INVENTION

Figure 1:
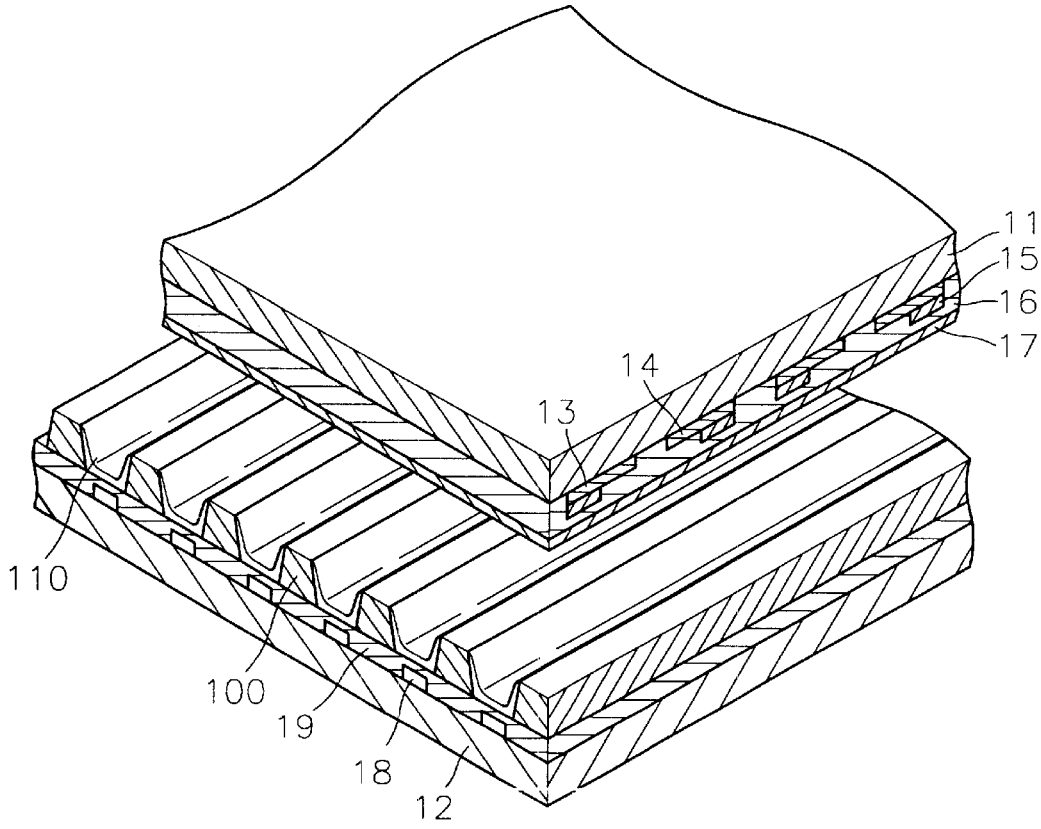
FIG. 1 (PRIOR ART)
FIG. 1 is a view showing a plasma display panel (PDP) among general flat displays.
Figure 2:
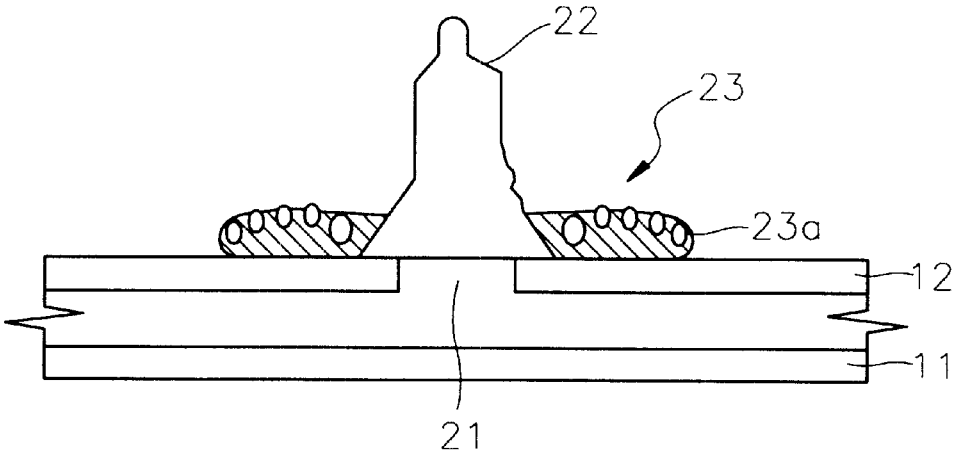
FIG. 2 (PRIOR ART)
FIG. 2 is a view showing a conventional sealing of an evacuation pipe in a PDP
Figure 3:
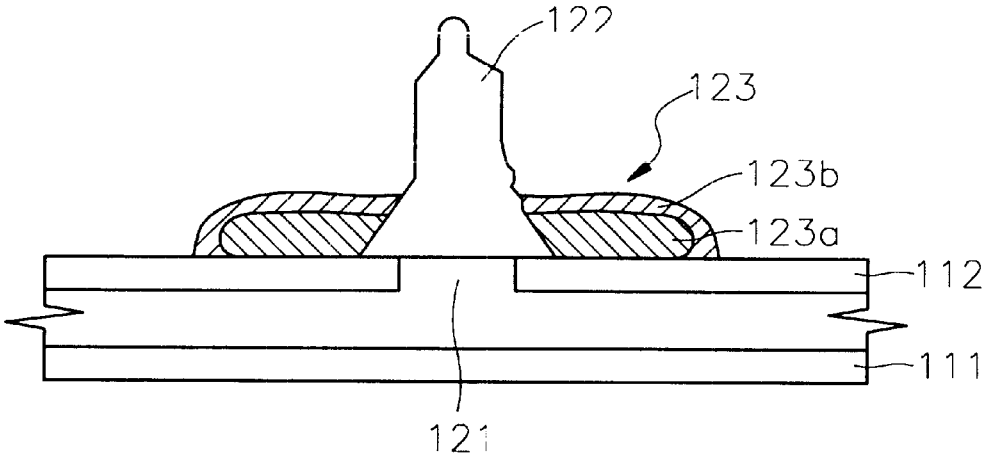
FIG. 3 is a view showing a sealing of an evacuation pipe using a sealing area of a flat display according to the present invention.

Referring to FIG. 3, a sealing area 123 of a flat display according to an embodiment of the present invention includes a frit glass 123*a* for sealing an evacuation pipe 122 to a rear substrate 112 around an evacuation hole 121 formed thereon and a moisture-resistant coating layer 123*b* formed on the surface of the frit glass 123*a*. The sealing area 123 is formed by aligning the evacuation pipe 122 over the evacuation hole 121 in the rear substrate 112, melting the frit glass 123*a* applied around the base of the evacuation pipe 122 to seal the evacuation pipe 122 to the rear substrate 112 around the evacuation hole 121, and coating the surface of the frit glass 123*a* with the moisture-resistant coating layer 123*b*.

The moisture-resistant coating layer 123*b* is preferably formed by a spray method. In this case, the evacuation pipe 122 is sealed to the rear substrate 112 after a discharge gas is injected into the space between the front and rear substrates 111 and 112.

The moisture-resistant coating layer 123*b* characterizing the present invention is formed of an acryl-type material. More specifically, the moisture-resistant coating layer 123*b* preferably includes 28.6% of acryl resin, 9.9% of aromatic solvent, 8.3% of alcohol solvent and 8.3% of ester solvent. The moisture-resistant coating layer 123*b* is about 10 nm thick. The coating layer 123*b* has excellent properties of moisture-resistance, abrasion-resistance, acid resistance, alkali resistance, weather resistance and salt resistance.

The coating layer 123*b* may be formed by other method such as a dipping method or a dip method besides the spray method.

The sealing area 123 of the present invention was tested in a test environment of high temperature and humidity for its sealing effect. The test showed no surface deformation or cracks caused by decrease in intensity. More specifically, the surface of the sealing area 123 retained its original coating state even at the temperature of 50° C. and 98% humidity.

The sealing area 123 of a flat display according to the present invention is protected from surface deformation and cracks to thereby prevent vacuum break of a panel even if it is exposed to an environment of high temperature and humidity, a salty environment and an environment in which chemical reaction is apprehended when flat displays including the sealing area 123 are sold and used in various regions of various environments.

Since the coating layer 123*b* of the sealing area 123 is formed on the surface of the frit glass 123*a* using a typical method such as a spray method, deeping method or a dip method, the present invention rarely influences the indexes of an existing fabrication, thereby allowing convenient adoption in the fabrication.

Figure 4:
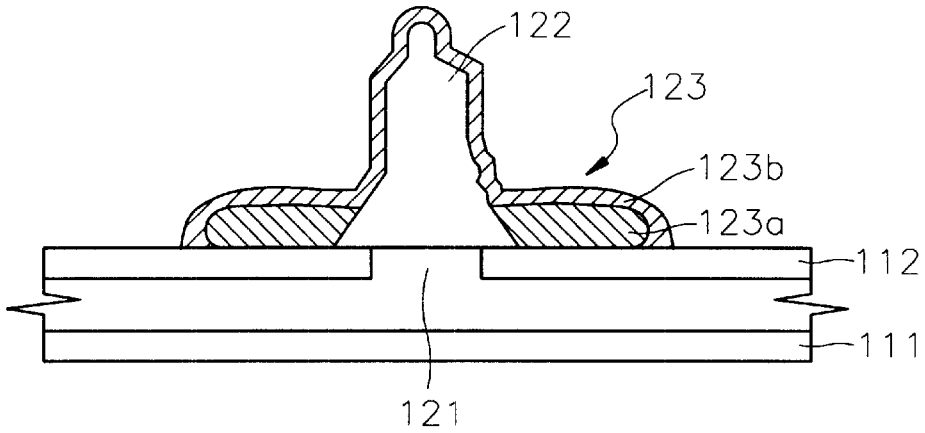
FIGS. 4 and 5 are views showing other embodiments of a sealing area of a flat display according to the present invention.

Referring to FIG. 4, as well as the surface of the frit glass 123*a*, the entire surface of the evacuation pipe 122 is coated with the coating layer 123*b*, thereby preventing the formation of a gap between the evacuation pipe 122 and the sealing area 123.

Figure 5:
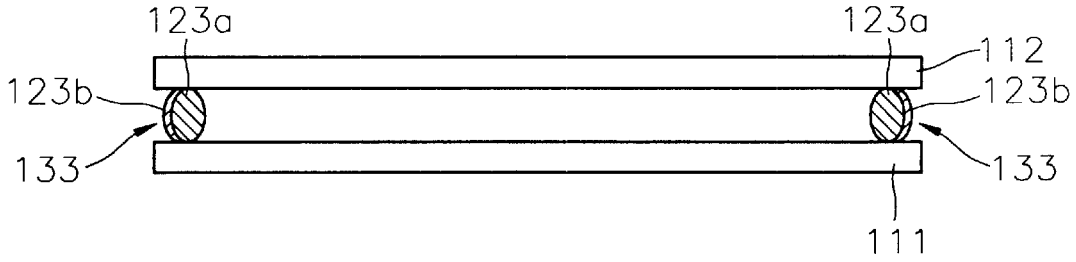

Referring to FIG. 5, a sealing area 133 according to another embodiment of the present invention is composed of a frit glass 123*a* for sealing a discharge space formed by front and rear substrates 111 and 112 provided to be opposed to each other and a coating layer 123*b* formed on the surface of the frit glass 123*a*. More specifically, the coating layer 123*b* is formed on the surface of the frit glass 123*a* exposed to the air.

As described above, a sealing area of a flat display according to the present invention is formed by coating an acryl-type moisture-resistant coating layer on the surface of a frit glass exposed to the air, thereby preventing surface deformation of the frit glass caused by permeation of moisture and cracks on the sealing area in various environments. Consequently, the defective proportion of products can be reduced.

What is claimed is:

1. A sealing area of a flat display, the sealing area comprising:

front and rear substrates provided to be opposed to each other, the front and rear substrates being sealed to each other using frit glass so as to form a discharge space;

an evacuation pipe sealed to the outer surface of the rear substrate using frit glass, and a moisture-resistant coating layer formed on the surface of the frit glass.

2. The sealing area of claim 1, wherein the moisture-resistant coating layer is formed on the surface of the frit glass and the surface of the evacuation pipe.

3. The sealing area of claim 1, wherein the moisture-resistant coating layer is formed of an acryl-type material.

4. The sealing area of claim 3, wherein the moisture-resistant coating layer is formed of 28.6% of acryl resin, 9.9% of aromatic solvent, 8.3% of alcohol solvent and 8.3% of ester solvent.

5. The sealing area of claim 1, wherein the moisture-resistant coating layer is 10 $\mu$m thick.

* * * * *